United States Patent [19]

Bagg

[11] Patent Number: 4,741,565

[45] Date of Patent: May 3, 1988

[54] DISPOSAL LITTER COLLECTOR

[76] Inventor: Richard L. Bagg, 849 Brookwood Ave., Vallejo, Calif. 94591

[21] Appl. No.: 932,474

[22] Filed: Nov. 19, 1986

[51] Int. Cl.[4] ..... A01K 29/00

[52] U.S. Cl. ..... 294/1.3; 15/257.1; 294/55

[58] Field of Search ..... 294/1.3–1.5, 294/55; 15/104.8, 257.1, 257.6; 220/85 B; 229/DIG. 3; 383/71, 72, 75, 78

[56] References Cited

U.S. PATENT DOCUMENTS

| | | | |
|---|---|---|---|
| D. 233,158 | 10/1974 | Lowe | 294/55 X |
| D. 255,951 | 7/1980 | Halls et al. | 294/1.3 X |
| D. 256,173 | 7/1980 | Rigney | 294/1.3 X |
| 1,692,777 | 11/1928 | Jewell | 229/DIG. 3 X |
| 3,676,887 | 7/1972 | Klein | 294/1.3 |
| 3,739,418 | 6/1973 | Yonaites et al. | 294/1.3 |
| 3,806,984 | 4/1974 | Hilsabeck | 294/1.3 |
| 3,837,696 | 9/1974 | Dahlke | 294/1.3 |
| 3,850,467 | 11/1974 | Johnson | 15/104.8 X |
| 3,885,266 | 5/1975 | Nafziger | 294/1.3 |
| 4,138,153 | 2/1979 | Brown | 294/1.3 X |
| 4,156,400 | 5/1979 | Migdal | 294/1.3 X |
| 4,186,955 | 2/1980 | Campbell | 294/1.3 |
| 4,215,886 | 8/1980 | Naderi et al. | 294/1.3 |
| 4,251,097 | 2/1981 | Whitten | 294/1.3 |

FOREIGN PATENT DOCUMENTS

| | | | |
|---|---|---|---|
| 257020 | 2/1913 | Fed. Rep. of Germany | 15/257.1 |

*Primary Examiner*—Johnny D. Cherry
*Attorney, Agent, or Firm*—Robert T. Kloeppel

[57] ABSTRACT

A portable and disposal litter collector for scooping up pet feces or other similar litter. The collector includes a hooded shovel. The shovel blade may be constructed with holes in its bottom to allow particles equal to or smaller than the hole size to escape. Connected to the shovel handle is a moisture impregnable flexible cover. The cover is draped back over the handle and the user's hand to avoid user contamination. After the litter is scooped up, the sleeve is draped back over the hooded shovel and drawn close so that the litter cannot fall out as it is taken to the nearest receptacle for disposal.

19 Claims, 1 Drawing Sheet

DISPOSAL LITTER COLLECTOR

BACKGROUND OF THE INVENTION

1. Field of the Invention

This invention relates to an improved disposable litter shovel. More specifically the invention relates to a portable shovel with an expandable volumetric capacity to accommodate pet feces of different magnitudes. The invention includes a protective sleeve to protect the user's hand and arm from contact with the animal feces scooped up by the invention, the sleeve being adaptable to be used as a disposable bag containing the feces and the shovel.

2. Discussion of Prior Art

Pet owners are constantly faced with the question of what to do with their pet's execrement which is defecated when they walk or jog their dog. Often local law requires them to dispose of it. Some pet owners respond by carrying a heavy garden type shovel. And others have invented light weight scoops that may be carried in a pet owner's pocket. These inventions have, however, shown some disadvantages. Some are difficult to assemble or difficult to grasp while holding onto the pet leash, or are non-adjustable to accommodate different size feces, or have insufficient structural component composite strength to adequately retain pet feces so that they do not fall to the ground after being scooped up.

One example of a portable disposable scooper is set forth in U.S. Pat. No. 4,215,886. This type has a one point attachment for the sleeve which may result in the sleeve falling off at critical times, such as when the sleeve is slipped back over the shovel for subsequent disposal of the feces which have been scooped into the shovel. The user is also required to use both of his hands when scraping up the feces, making it difficult to hold onto the dog leash. Additionally the scooper is a predetermined size which in turn limits the maximum size of feces or litter that may be scooped up.

In contrast my invention provides a separate handle that can be grasped by the whole hand and not just the finger tips. Also the sleeve in my invention is secured at one end around its entire perimeter to the shovel, for greater strength. Additionally my invention has expandable folds to facilitate its ability to accommodate feces or other similar litter of different sizes. Thus my invention is inexpensive, expandable to accommodate different size feces yet contractable for easy storage in the user's clothes when walking or jogging or for shipping purpose when the user travels or a manufacturer ships the invention for commercial reasons. My invention may also be made of different overall size to accommodate feces from different size pets. Further, because of the connection of the sleeve to the shovel, the probability of getting contaminated by excrement after the user has picked it up due to separation of the sleeve from the shovel is diminished significantly.

The invention eliminates the need of a separate scraper that other have used. The separate scraper is an item which can get lost and also makes it difficult for one to hold onto the leash of a dog while the user is scraping up the excrement with a scraper in one hand and holding the disposable unit in the other.

Additionally, cat owners face a dilemma of either picking up cat feces from a cat litter box or throwing out the entire contents of the litter box including all the kitty litter. In the past if a scooper was used for picking up individual cat feces, kitty litter would be scooped up with the feces, eventually resulting in having to replace the litter sooner than would be otherwise necessary. In one embodiment of my invention, the shovel bottom has holes so that by shaking the shovel from side to side any kitty litter picked up with the feces will fall through the holes and back to the kitty box. This aspect of my invention should result in cost savings because kitty litter need not be replaces as frequently. Additionally the use of this feature of my invention reduces the probability of an unpleasant odor emanating from the litter box which may otherwise occur for those who elect to collect a "full" litter box of cat feces in order to economize on kitty litter replacement.

SUMMARY OF THE INVENTION

My invention is a disposable litter scoop. The invention includes a shovel with a handle that can be easily grasped with the hand. The shovel has a hood and a shovel bottom which forms a receiver for the scooped up litter. A moisture impregnable sleeve is connected or manufactured integral with the shovel. The moisture impregnable sleeve is then slipped back over the hooded shovel. The sleeve is drawn or tied tight and discarded. The bottom of the shovel may have holes fabricated or punched into it so that kitty litter can fall through the holes when the user of the invention shakes it from side to side. The invention may also have means in the hood that permits the hood to expand to accommodate different size feces or other matter desired to be disposed. The invention thus can be contracted to be stored or shipped. The invention can also be constructed in different overall sizes for use with pets which have correspondingly larger or smaller feces. Besides these aspects and advantages of the invention, other ones will become apparent from the drawings, description of the preferred embodiment and the claims.

DESCRIPTION OF THE PREFERRED EMBODIMENT

Figure 6:
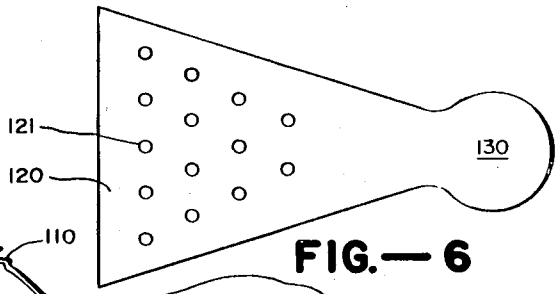
FIG. 6 illustrates a partial plan of the flat bottom which in turn illustrates an alternate embodiment of the invention that has holes or perforations in the flat bottom.

Referring to FIGS. 1–5, the invention or disposable litter collector 100 is shown with flexible sleeve 150. One end of the draw string 140 enters through a slit 162 in the seam 160 and passes into and along the seam exiting at the other side of the slit. The seam is fabricated at the open end of the sleeve, the sleeve's end which is opposite the sleeve's attachment to handle 130 of the shovel. The seam extends along the entire perimeter of the open end of the sleeve. Another means of drawing, tying or securing the bag closed are tabs 145 extending at opposite sides of the sleeve, FIG. 5.

The shovel is made from pressed paper, plastic or other material which can be manufactured to provide sufficient strength so that it can be disposed without great financial concern. Though a few materials are mentioned, others may be used as are found suitable by those skilled in the art.

The shovel has a flat bottom 120 with or without holes 121, FIG. 6. The size of the holes or perforations in the flat bottom should be large enough to pass particles that the user does not wish to dispose with the pet feces. For example, if the user is picking up feces from a cat litter box, the holes or perforations should be big enough to only pass the kitty litter. The flat bottom has a leading edge 122 for scooping up the litter. The two opposite side edges 124, 126 of the flat bottom taper into handle 130. The flat bottom and handle can, however, be separate pieces mechanically fastened together or otherwise made integral if this is desirable. From the side edge extends a hood 125. The hood illustrated is internally concave and is in a spaced relationship or vertically spaced from the leading edge 122 of the shovel bottom 120. Hood 125 tapers from the shovel's leading edge to back of the hood which is connected or fabricated integral with the handle. This combination of the hood and the flat bottom results in a receiver for litter. Other hoods can be formed other than the one illustrated such as one made with vertical sides and back and horizontal top. The main criteria a person skilled in the art should meet regardless of the shape of the hood is to have a hood that is constructed so that it maintains a spaced relationship at the leading edge of the shovel so that feces or litter can pass into the area circumscribed by the flat bottom and the hood.

Figure 2:
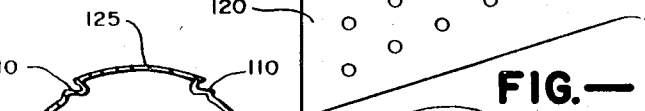
FIG. 2 is a cross sectional view taken on line 2—2 of FIG. 1. It shows in detail the opening of the invention.
Figure 4:
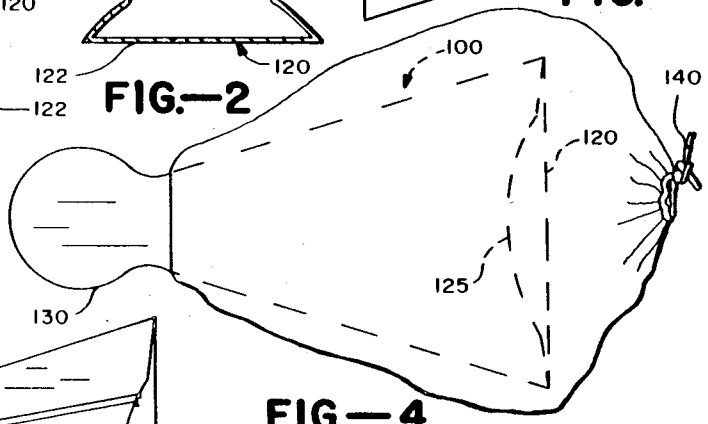
FIG. 4 shows the invention in plan view with the litter on the shovel with the open end of the sleeve secured and the invention ready for disposal.
Figure 5:
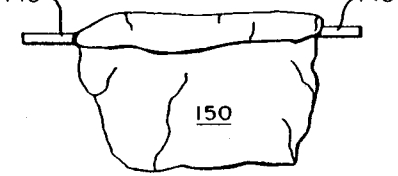
FIG. 5 illustrates the tabs extending from the sleeve to tie the invention closed.
Figure 1:
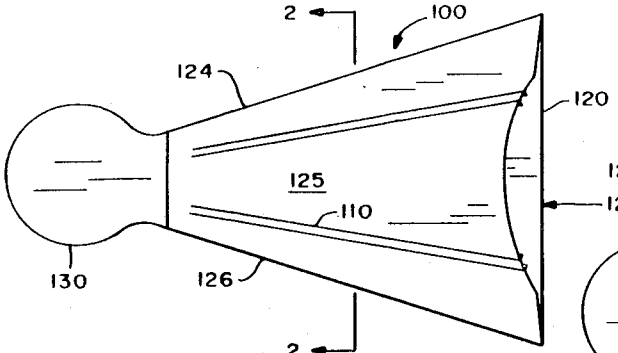
FIG. 1 is plan view of the disposable litter scooper of the preferred embodiment of the invention.

As illustrated in FIG. 2, one embodiment of my invention has excess material manufactured integral into the top as folds 110 to permit the hood 125 to expand or contract. This feature allows the shovel to accommodate litter of different magnitudes without unduly stressing the sleeve or falling off the shovel before moving the sleeve back over the shovel. The expandable folds also allow the invention to contract prior to use so that the invention fits more easily into the pet owner's pocket or for that matter may be more economically shipped. If feces of a pet exceed the size of the receiver formed by the hood 125 and the flat bottom 120 of the shovel, the invention of course can be made of different overall size to accommodate such larger feces. Integral to the shovel is a handle 130.

As previously mentioned, a moisture impregnable sleeve 150 is mechanically fastened or otherwise secured to the handle 130 in the vicinity of where the back end of the hood fastens to the handle. The exact location of the mechanical fastening is not critical as long as one end of the sleeve is fastened circumferentially to scooper 100 so that the scooper is centrally located within the sleeve. The moisture impregnable sleeve 150 may be made from plastic sheets or other materials which meet the criteria of flexibility, moisture impregnableness, and economy. The sleeve is fastened to the handle 130 by a mechanical means such as heat sealing, tape, glue or staples or otherwise fabricated into the handle. The sleeve is of sufficient length to extend past the leading edge 122 of the flat bottom 120 of the shovel.

Figure 3:
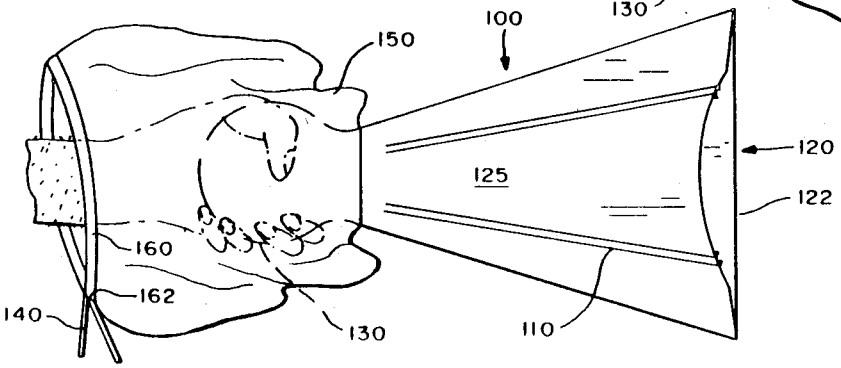
FIG. 3 is a plan view of the preferred embodiment showing the sleeve of the preferred embodiment covering the arm of the user of the invention.

To operate the invention 100, sleeve 150 is rolled back over the hand and arm of the user, FIG. 3. After expanding the opening of the shovel to the appropriate size, the user's hand clutches or grasps handle 130 and shovels up the feces or other litter. If the feces are located in a kitty litter box, after the cat feces are scooped onto the shovel, the shovel is moved side to side so that any kitty litter picked up with the feces drops back into the litter box through holes fabricated into the bottom of the shovel.

After the feces or litter is scooped onto the shovel, the sleeve 150 is rolled back over the shovel and hood 125. The draw string 140 or tabs 145 are drawn tight and may be tied so that the feces cannot fall out. The invention used in this manner may be carried to the nearest receptacle to avoid contamination of one's clothes or losing it enroute to the receptacle.

What I claim:

1. A disposable litter scooper comprising: a shovel having a flat bottom; the flat bottom having a leading edge and two opposite side edges, both side edges of the flat bottom tapering into a handle; said handle extending from the flat bottom; a hood extending from one side edge of the flat bottom to the other side edge of the flat bottom; one end of the hood being vertically spaced from the leading edge of the flat bottom and the other end of the hood connected to the handle so that the flat bottom forms a receiver for litter; a moisture impregnable sleeve mechanically fastened at one end circumferentially to said scooper so that said scooper is centrally located within said sleeve and the other end of the sleeve opened, the sleeve having sufficient length to extend past the leading edge of the flat bottom, and means at the open end of the sleeve to draw close the open end of the sleeve.

2. The litter scooper of claim 1 wherein the bottom of the shovel has perforations to allow particles that are picked up with the litter to fall through the perforations.

3. The litter scooper of claim 1 wherein the means to draw close the open end of the sleeve are tabs which extend from the sleeve, wherein the tabs are of sufficient length to tie the open end closed.

4. The litter scooper of claim 1 wherein the hood has folds with excess material which may expand to accommodate litter of different magnitudes.

5. The scooper of claim 1 wherein the means to draw close the open end of the sleeve comprises a seam made at the open end of the sleeve, the seam extending along the entire perimeter of the open end of the sleeve, the seam having a slit and a draw string entering through the slit and extending into and along the seam and exiting the other side of the slit.

6. The litter scooper of claim 1 wherein the means to draw close the open end of the sleeve are tabs which extend from the sleeve, wherein the tabs are of sufficient length to tie the open end closed; and wherein the hood has folds with excess material which may expand to accommodate litter of different magnitudes.

7. The litter scooper of claim 1 wherein the hood has folds with excess material which may expand to accommodate litter of different magnitudes; and wherein the means to draw close the open end of the sleeve comprises a seam made at the open end of the sleeve, the seam extending along the entire perimeter of the open end of the sleeve, the seam having a slit and a draw string entering through the slit and extending into and along the seam and exiting the other side of the slit.

8. The litter scooper of claim 1 wherein the bottom of the shovel has perforations to allow particles that are picked up with the litter and are smaller than the perforations to fall through the perforations; and wherein the means to draw close the open end of the sleeve are tabs which extend from the sleve, wherein the tabs are of sufficient length to tie the open end closed; and wherein the hood has folds with excess material which may expand to accommodate litter of different magnitudes.

9. The litter scooper of claim 1 wherein the bottom of the shovel has perforations to allow particles that are picked up with litter and are smaller than the perforations to fall through the perforations; and wherein the hood has folds with excess material which may expand to accommodate litter of different magnitudes; and wherein the means to draw close the open end of the sleeve comprises a seam made at the open end of the sleeve, the seam extending along the entire perimeter of the open end of the sleeve, the seam having a slit and a draw string entering through the slit and extending into and along the seam and exiting the other side of the slit.

10. A disposable litter scooper comprising: a shovel having a flat bottom and a hood extending from one side edge of the flat bottom of shovel to the other side edge of the flat bottom; the hood having internally concave sides and top; a handle extending from the shovel; a moisture impregnable flexible sleeve, wherein one end of the sleeve is mechanically fastened at one end circumferentially to said scooper so that said scooper is centrally located within said sleeve and the other end of the sleeve opened, the sleeve having sufficient length to extend past the shovel; folds in the hood of excess material from which the hood is made which may expand to accommodate litter of different magnitudes; means at the open end of the sleeve to draw close the open end of the sleeve.

11. The disposable litter scooper of claim 10 wherein the means at the open end of the sleeve to draw close the open end of the sleeve is a seam at the open end of the sleeve, the seam extending along the entire perimeter of the open end of the sleeve, the seam having a slit and a draw string entering through the slit and into and along the seam and exiting the other end of the slit.

12. The disposable litter scooper of claim 10 wherein the bottom of the shovel has holes to allow particles that are smaller than the holes that are picked up with the litter to fall through the holes.

13. The litter scooper of claim 10 wherein the means to draw close the open end of the sleeve are tabs which extend from the sleeve, wherein the tabs are of sufficient length to tie the open end closed.

14. A disposable litter scooper comprising: a shovel having a flat bottom; the flat bottom having a leading edge and two opposite side edges, both side edges of the flat bottom tapering into a handle; said handle extending from the flat bottom; wherein the flat bottom of the shovel has perforations to allow particles that are picked up with the litter and are smaller than the perforations to fall through the perforations; a hood extending from one side edge of the flat bottom to the other side edge of the flat bottom; one end of the hood being vertically spaced from the leading edge of the flat bottom and the other end of the hood connected to the handle so that the flat bottom forms a receiver for litter; a moisture impregnable sleeve mechanically fastened at one end circumferentially to said scooper so that said scooper is centrally located within said sleeve and the other end of the sleeve opened, the sleeve having sufficient length to extend past the leading edge of the flat bottom; and means at the open end of the sleeve to draw close the open end of the sleeve.

15. The litter scooper of claim 14 wherein the means to draw close to the open end of the sleeve are tabs which extend from the sleeve, wherein the tabs are of sufficient length to tie the open end closed.

16. The litter scooper of claim 14 wherein the hood has folds with excess material which may expand to accommodate litter of different magnitudes.

17. The scooper of claim 14 wherein the means to draw close the open end of the sleeve comprises a seam made at the open end of the sleeve, the seam extending along the entire perimeter of the open end of the sleeve, the seam having a slit and a draw string entering through the slit and extending into and along the seam and exiting the other side of the slit.

18. The litter scooper of claim 14 wherein the hood has folds with excess material which may expand to accommodate litter of different magnitudes; and wherein the means to draw close the open end of the sleeve comprises a seam made at the open end of the sleeve, the seam extending along the entire perimeter of the open end of the sleeve, the seam having a slit and a draw string entering through the slit and extending into and along the seam and exiting the other side of the slit.

19. The litter scooper of claim 14 wherein the means to draw close the open end of the sleeve are tabs which extend from the sleeve, wherein the tabs are of sufficient length to tie the open end closed; and wherein the hood has folds with excess material which may expand to accommodate litter of different magnitudes.

* * * * *